US006974228B2

(12) United States Patent
Weiser et al.

(10) Patent No.: US 6,974,228 B2
(45) Date of Patent: Dec. 13, 2005

(54) NOVELTY WITH SOLAR LIGHT

(75) Inventors: Isaac Weiser, Tarzana, CA (US); Margaret Weiser, Tarzana, CA (US)

(73) Assignee: Exhart Environmental Systems, Inc., Chatsworth, CA (US)

( * ) Notice: Subject to any disclaimer, the term of this patent is extended or adjusted under 35 U.S.C. 154(b) by 66 days.

(21) Appl. No.: 10/843,536

(22) Filed: May 10, 2004

(65) Prior Publication Data

US 2005/0248934 A1 Nov. 10, 2005

(51) Int. Cl.[7] ..... F21S 6/00

(52) U.S. Cl. ..... 362/124; 362/183; 362/806; 362/808; 446/72; D26/98

(58) Field of Search ..... 362/124, 183, 362/240, 431, 565, 808; 446/72, 485; D26/98

(56) References Cited

U.S. PATENT DOCUMENTS

| | | | | |
|---|---|---|---|---|
| 1,606,354 A * | 11/1926 | Fillion | 362/124 |
| 4,903,179 A | 2/1990 | Lin | 362/184 |
| D312,889 S | 12/1990 | Swadell | D26/168 |
| 5,003,439 A | 3/1991 | Yang | 362/153 |
| D323,406 S | 1/1992 | Fisher | D26/68 |
| 5,504,397 A | 4/1996 | Chien | 315/185 |
| 5,799,124 A | 8/1998 | Zorn et al. | 385/125 |
| D426,012 S | 5/2000 | Giese et al. | D26/68 |
| D444,253 S | 6/2001 | Blanchard | D26/67 |
| 6,328,457 B1 | 12/2001 | Huang | 362/353 |
| 6,392,541 B1 | 5/2002 | Bucher et al. | 340/332 |
| 6,513,957 B2 | 2/2003 | Huang | 362/431 |
| 2002/0097577 A1 | 7/2002 | Huang | 362/240 |
| 2002/0176260 A1 | 11/2002 | Liao | 362/551 |
| 2002/0196633 A1 | 12/2002 | Huang | 362/431 |

* cited by examiner

*Primary Examiner*—Stephen F Husar
(74) *Attorney, Agent, or Firm*—Cislo & Thomas LLP

(57) ABSTRACT

A novelty item comprising a simulated animal, bird, or vertebrate comprising a head, a body, and one or more appendages coupled to the body. The novelty item also includes a translucent rod having a first end and a second end where the first end of the rod is coupled to the body and the second end is coupled to a base. The translucent rod has a bore and one or more electromagnetic energy sources positioned within the bore. The base has one or more energy sources electrically coupled to the one or more electromagnetic energy sources. The novelty item also includes a securing means coupled to the base of the novelty item.

17 Claims, 3 Drawing Sheets

NOVELTY WITH SOLAR LIGHT

BACKGROUND

Various novelties have been developed that may be used outdoors and having varying aspects such as a fan or spinner that is acted upon by the wind. These novelty items are fabricated in such a manner as to be visibly discernable when incorporated in or with a whimsical, ornamental representation of an animal, insect, bird, or the like. The novelty items may have moving aspects such as a fan or spinner when acted upon by the wind to add to the visual enjoyment of an individual(s). While these prior novelty devices have been useful, there remains a need for a novelty that may be enjoyed day or night.

SUMMARY

Disclosed herein are various embodiments of a novelty item composed of a simulated animal, bird, or vertebrate having a head, body, and one or more appendages coupled to the body, and a translucent rod having a first end and a second end is coupled to the body of the simulated animal, bird, or vertebrate. The second end of the translucent rod is coupled to a base. The translucent rod also includes a bore and one or more electromagnetic energy sources positioned within the bore. According to one embodiment, the electromagnetic energy source is a light emitting diode. In another embodiment, the electromagnetic energy source may be a light bulb. The base of the novelty item includes one or more energy sources, which are electrically coupled to the one or more electromagnetic energy sources. The novelty item also includes a securing means coupled to the base. In one embodiment, the securing means is composed of a staking structure coupled to a spacing element.

DETAILED DESCRIPTION

The detailed description set forth below in connection with the appended drawings is intended as a description of various embodiments and is not intended to represent the only forms in which the embodiments may be constructed and/or utilized. However, it is to be understood that the same or equivalent functions and sequences may be accomplished by different embodiments that are also intended to be encompassed within the spirit and scope of the specification.

Figure 1:
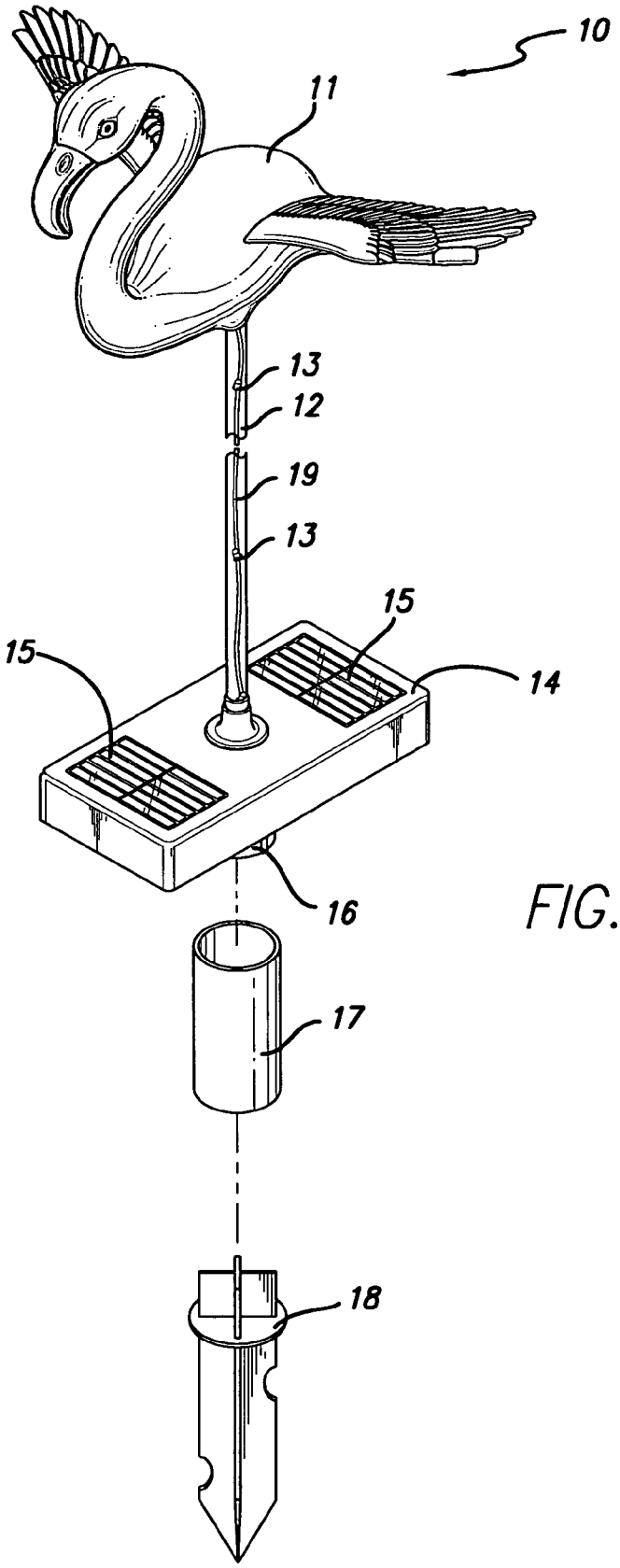
FIG. 1 is an exploded perspective view of one embodiment.

FIG. 1 illustrates one embodiment of a novelty item 10. The novelty item 10 includes a simulated animal, bird, or vertebrate 11 having a head, body, and one or more appendages coupled to the body. As shown in FIG. 1, the novelty item includes a simulated bird 11. A translucent rod 12 is coupled to the base of the bird 11 and to a base member 14. The rod 12 is translucent and includes a bore that extends along the longitudinal axis of the translucent rod 12. Within the bore of the rod 12, a plurality of electromagnetic energy sources 13 are positioned therein. According to one embodiment, the electromagnetic energy sources 13 can be light emitting diodes, light bulbs, or a combination thereof. The electromagnetic energy sources 13 are coupled together via electrical connectors 19. The electrical connectors 19 may be wire or other coupling means known or developed in the art.

As shown in FIG. 1, the base 14 is a generally rectangular housing. As those skilled in the art will appreciate, the base 14 may have a plurality of different shapes other than what is depicted in FIG. 1. The base 14 may include one or more energy sources 13. As shown in FIG. 1, the energy source 13 may be one or more solar panels 15. The solar panels 15 are positioned at opposite ends of the base 14. In other embodiments, the energy sources 13 can be one or more batteries, a renewable energy source, a capacitor, or combination thereof. According to one embodiment, the base 14 may include a plurality of batteries and one or more solar panels 15. The solar panels 15 may be utilized to recharge the batteries that are contained within the base 14. In these various embodiments, the solar panels 15 can be coupled to the energy sources 13 via the electrical connectors 19.

The novelty item 10 may be affixed to a surface by a securing means. According to one embodiment, the securing means may be composed of a staking structure 18 and a spacing element 17. As shown in FIG. 1, the staking structure 18 is a generally elongate structure having a pointed end at a first end and a circular end at a second end. The second end is adapted to engage the base 14 or the spacing element 17. The staking structure 18 includes a plurality of vanes that are shaped so that the staking means 18 may be easily inserted into the ground. Staking means 18 may also include a plurality of notches on one or more of the vanes.

According to one embodiment, the spacing element 17 is a generally cylindrical structure having an inner bore extending along the longitudinal axis of the spacing element 17. As those skilled in the art will appreciate, the spacing element 17 may have varying lengths in order to provide clearance between the novelty item 10 and the ground. As shown in FIG. 1, the spacing element 17 may be coupled to a protuberance 16 that is positioned on the bottom of the base 14. The protuberance 16 is sized to engage the inner wall of the spacing element 17. At the opposite of the spacing element 17, the staking structure 18 is sized and shaped such that it will engage the inner wall of the spacing element 17.

In other embodiments, the staking structure 18 may be directly secured to the bottom of the base member 14. In yet another embodiment, the spacing element 17 may be secured to a weighted disk or other planar surface to ensure the novelty item 20 is standing upright in a desired location. In yet another embodiment, the spacing element 17 may be positioned within a bore of a hole of a fixed element or a hole in the ground.

Figure 2:
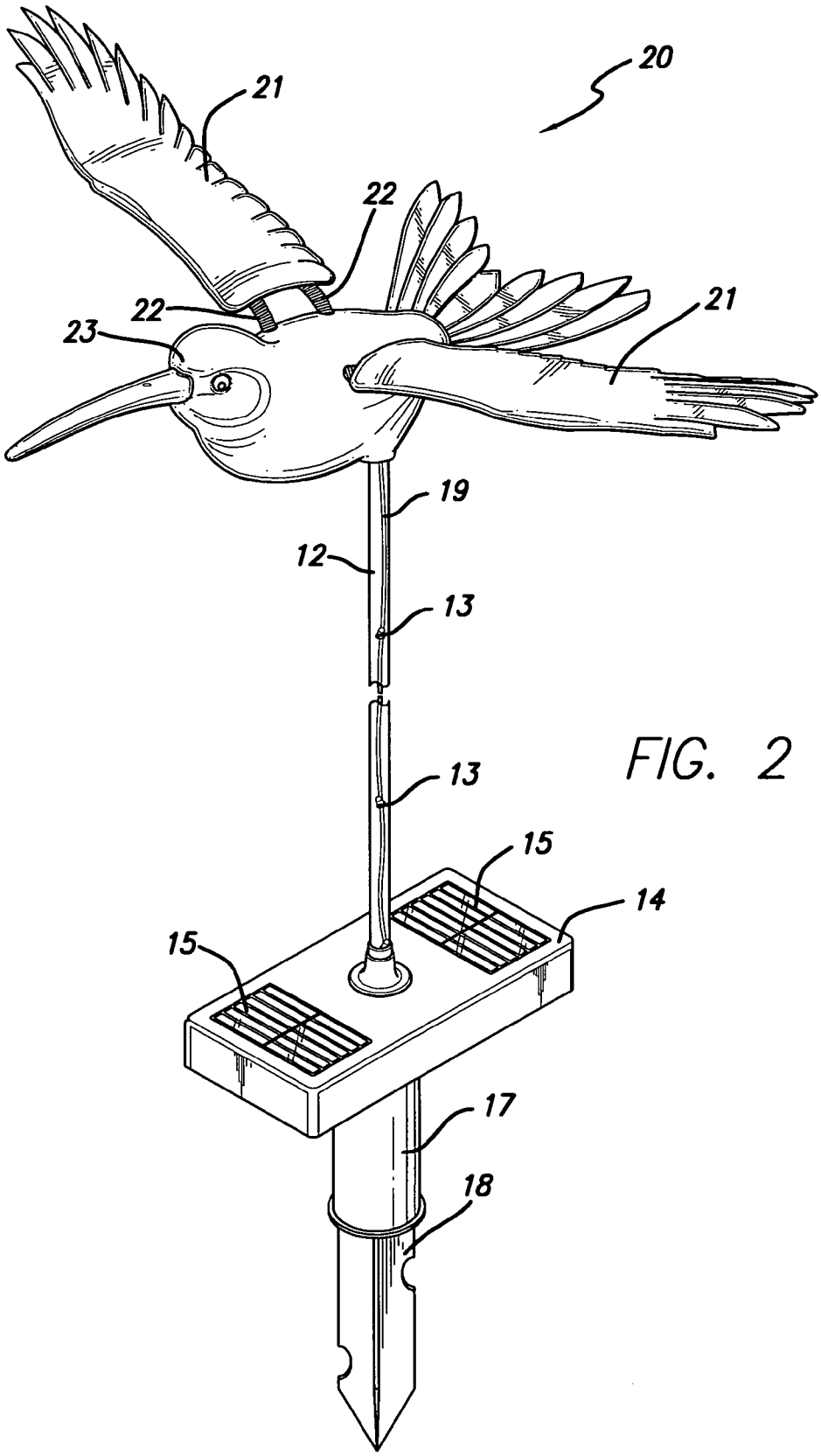
FIG. 2 is a perspective view of another embodiment.

FIG. 2 illustrates another embodiment of a novelty item 20. The novelty item 20 includes a simulated animal, bird, or vertebrate 23. The simulated animal, bird, or vertebrate 23 may include appendages 21 that are coupled to the body of the simulated animal, bird, or vertebrate 23. The appendages 21 are coupled to the body of the simulated animal, bird, or vertebrate 23 by resilient members 22. According to one embodiment, the resilient members 22 are springs.

Like the embodiment depicted in FIG. 1, the embodiment depicted in FIG. 2 also includes a translucent rod 12 having an internal bore. The translucent rod 12 houses a plurality of electromagnetic energy sources 13 and electrical connectors 19. The electromagnetic energy sources 13 are coupled together via the electrical connectors 19. Again like the embodiment depicted in FIG. 1, the electromagnetic energy sources 13 are electrically coupled to an energy source 15 which is contained in a base housing 14.

Figure 3:
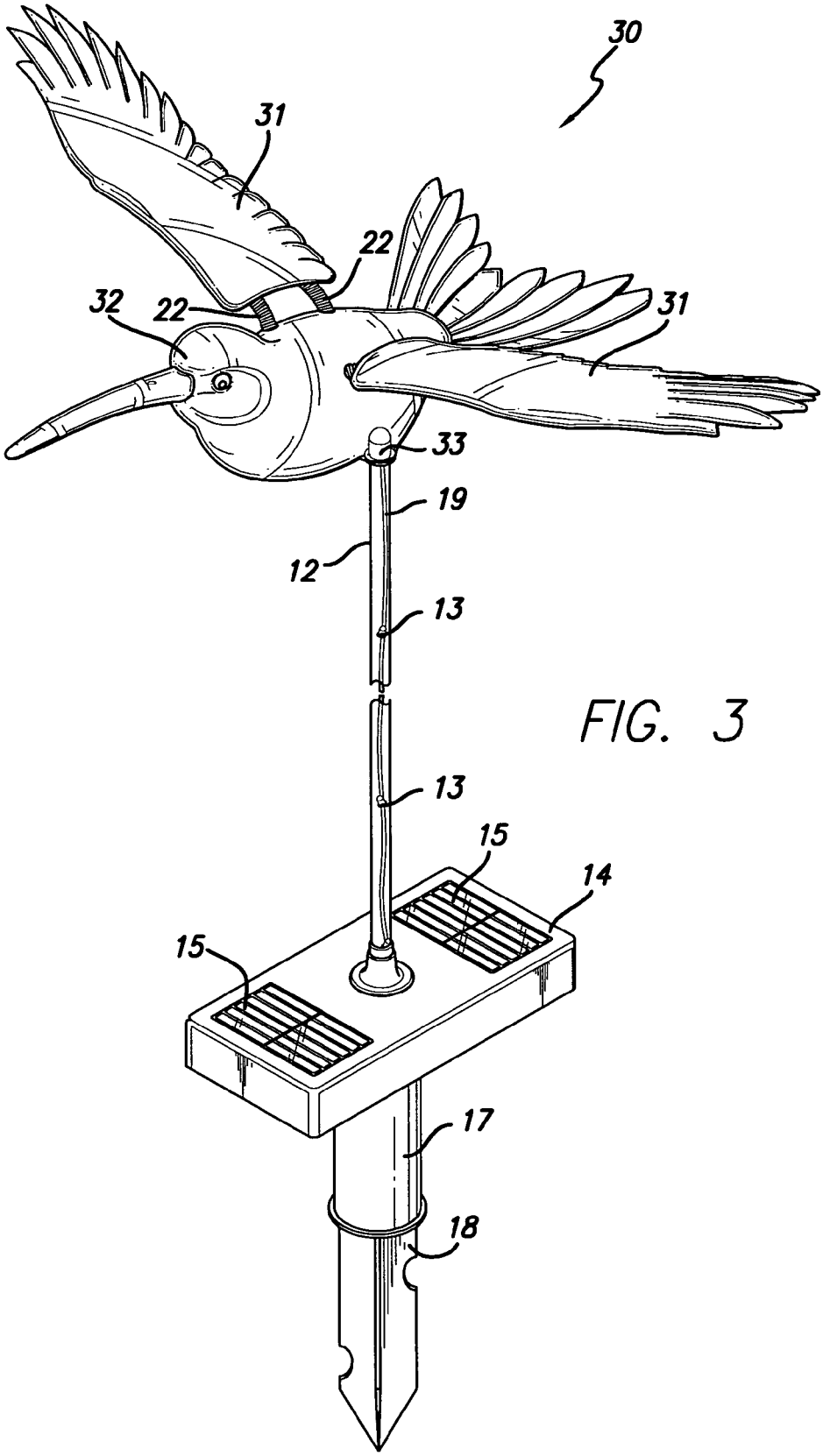
FIG. 3 is a perspective view of yet another embodiment.

FIG. 3 illustrates yet another embodiment of the novelty item 30. The novelty item 30 is similar to the novelty items 10 and 20 depicted in FIGS. 1 and 2, respectively, with the exception that the simulated animal, bird, or vertebrate 32 is translucent. As those skilled in the art will appreciate, in alternate embodiments, a portion of the simulated animal, bird, or vertebrate may be opaque. As shown in FIG. 3, the simulated bird 32 includes appendages 31 that are coupled to the body via resilient members 22. As depicted in FIG. 3, the appendages 31 are wings. In other embodiments, the tail of the novelty item 30 may be coupled to the body via resilient members 22. As those skilled in the art will appreciate, depending upon the simulated animal, bird, or vertebrate 32, one or more appendages 31 may be secured to the body via one or more resilient members 22. Alternatively, the appendages 31 may be directly secured to the body of the simulated animal, bird, or vertebrate 32.

As shown in FIG. 3, a translucent rod 12 also includes a protuberance 33 at one end. In one embodiments, the protuberance 33 can be translucent. According to one embodiment, an electromagnetic energy source 13 may be positioned within the protuberance 33. Accordingly, in use, when the electromagnetic energy source 13 is illuminated, the body of the simulated animal, bird, or vertebrate 32 is also illuminated.

In closing, it is to be understood that the exemplary embodiments described herein are illustrative of the principles of the present invention. Other modifications that may be employed are within the scope of the invention. Thus, by way of example, but not of limitation, alternative configurations may be utilized in accordance with the teachings herein. Accordingly, the drawings and description are illustrative and not meant to be a limitation thereof.

What is claimed is:

1. A novelty item, comprising:

a simulated animal, bird, or vertebrate comprising a head, a body, and one or more appendages coupled to the body;

a translucent rod having a first end and a second end, the first end of the rod coupled to the body and the second end coupled to a base, the translucent rod having a bore and one or more electromagnetic energy sources positioned within the bore;

the base having one or more energy sources, the one or more energy sources electrically coupled to the one or more electromagnetic energy sources; and a securing means coupled to the base.

2. The novelty item of claim 1 wherein the one or more appendages are coupled to the body by a spring means.

3. The novelty item of claim 1 wherein the simulated animal, bird, or vertebrate is translucent.

4. The novelty item of claim 1 wherein the simulated animal, bird, or vertebrate is opaque.

5. The novelty item of claim 1 wherein the one or more electromagnetic energy sources are light emitting diodes, light bulbs, or a combination thereof.

6. The novelty item of claim 1 wherein the one or more energy sources is a battery, a solar panel, a renewable energy source, a capacitor, or a combination thereof.

7. The novelty item of claim 1 wherein the securing means comprises a staking structure coupled to a spacing element.

8. The novelty item of claim 1 wherein one electromagnetic energy source is positioned at a first end of the translucent rod.

9. A novelty item, comprising:

a simulated animal, bird, or vertebrate comprising a head, a body, and one or more appendages coupled to the body, wherein at least a portion of the simulated animal, bird, or vertebrate is translucent;

a translucent rod having a first end and a second end, the first end of the rod coupled to the body and the second end coupled to a base, the translucent rod having a bore and one or more electromagnetic energy sources positioned within the bore;

the base having one or more energy sources, the one or more energy sources electrically coupled to the one or more electromagnetic energy sources; and a securing structure reversibly coupled to a spacing element, wherein the spacing element is coupled to the base.

10. The novelty item of claim 9 wherein the one or more appendages are coupled to the body by a spring means.

11. The novelty item of claim 9 wherein the one or more electromagnetic energy sources are light emitting diodes, light bulbs, or a combination thereof.

12. The novelty item of claim 9 wherein one electromagnetic energy source is positioned at a first end of the translucent rod.

13. The novelty item of claim 9 wherein the one or more energy sources is a battery, a solar panel, a renewable energy source, a capacitor, or a combination thereof.

14. A novelty item, comprising:

a simulated animal, bird, or vertebrate comprising a head, a body, and one or more appendages resiliently coupled to the body, wherein the head, body, and one or more appendages are translucent;

a translucent rod having a first end and a second end, the first end of the rod coupled to the body and the second end coupled to a base, the translucent rod having a bore and one or more light emitting diodes (LEDs) positioned within the bore;

the base having one or more energy sources, the one or more energy sources electrically coupled to the LEDs; and a securing structure reversibly coupled to a spacing element, wherein the spacing element is coupled to the base.

15. The novelty item of claim 14 wherein the one or more energy sources is a battery, a solar panel, a renewable energy source, a capacitor, or a combination thereof.

16. The novelty item of claim 14 wherein at least one LED is positioned at the first end of the translucent rod.

17. The novelty item of claim 14 wherein the spacing element is coupled to a protuberance positioned on a bottom of the base.

* * * * *